United States Patent [19]

Pentney

[11] 4,090,638

[45] May 23, 1978

[54] SHAVING UNIT DISPENSER

[75] Inventor: Harry Pentney, Reading, England

[73] Assignee: The Gillette Company, Boston, Mass.

[21] Appl. No.: 733,537

[22] Filed: Oct. 18, 1976

Related U.S. Application Data

[62] Division of Ser. No. 682,324, May 3, 1976, Pat. No. 4,043,035.

[30] Foreign Application Priority Data

May 29, 1975 United Kingdom ..... 23499/75

[51] Int. Cl.[2] ..... A45D 27/24

[52] U.S. Cl. ..... 221/307; 30/40; 206/356

[58] Field of Search ..... 221/220, 307, 312 R, 221/312 A, 312 BC; 206/352, 355, 356, 359, 360; 30/40, 40.2

[56] References Cited

U.S. PATENT DOCUMENTS

| | | | |
|---|---|---|---|
| 2,418,495 | 4/1947 | Auerbach | 206/356 |
| 2,468,612 | 4/1949 | Auerbach | 30/40.2 X |
| 3,771,223 | 11/1973 | Davidowicz et al. | 30/40 |
| 3,941,244 | 3/1976 | Braginetz | 206/360 |
| 4,034,892 | 7/1977 | Braginetz | 206/356 X |

*Primary Examiner*—Robert B. Reeves
*Assistant Examiner*—Fred A. Silverberg
*Attorney, Agent, or Firm*—Richard A. Wise; O. J. Bratlie; S. R. Foster

[57] ABSTRACT

A shaving unit dispenser including means for locating a razor handle in a loading position in which a shaving unit can be transferred from a storage position in the dispenser to a position of operative engagement with the handle, and latch means which prevents movement of the shaving unit from its storage position, the latch means being operated to release the shaving unit by location of the razor handle in the loading position.

3 Claims, 6 Drawing Figures

SHAVING UNIT DISPENSER

This is a divisional of application Ser. No. 682,324, filed May 3, 1976 now U.S. Pat. No. 4,043,035.

This invention relates to containers for holding during transport and storage, one or more replaceable elements of a safety razor. Each such element may consist simply of a bare blade having one or more cutting edges, or may comprise an assembly of two or more blades which provide a set of cutting edges adapted for simultaneous use, or more than one such set. Alternatively, the replaceable element may constitute what has become known in the art as a "shaving unit" or "cartridge," comprising a blade or blades and also a member permanently coupled to the blade(s) and which provides the guard surfaces for the cutting edge or edges thereof.

The very wide variety of known containers for replaceable elements of these different types includes containers for bare blades which are provided with means for engaging the razor frame or handle with which the blades are to be used and locating that handle in a specific loading position, in which its blade-receiving portion is in alignment with an opening through which a blade can be discharged from the storage space of the container. The arrangement is such that after the handle has been thus coupled to the container the blade can be slid out of the storage space into correct operative engagement with the handle, subsequent disengagement of the handle and container leaving the transferred blade in position on the handle, ready for use.

A container in accordance with the present invention includes means for locating a razor frame or handle in a loading position in which an element can be transferred from a storage position in the container into a position of operative engagement with the handle, and latch means which prevent movement of the element from its storage position, the latch means being operated to release the element by location of the razor handle in the loading position. Discharge or replacement of the element from the container is accordingly prevented except when the razor handle is correctly positioned to receive the element upon such a discharge.

The two particular embodiments of the invention which by way of example are shown in the accompanying drawings and described below, are intended for the storage of shaving units, or cartridges, each of which includes a pair of single-edged blades, disposed so that their cutting edges are parallel and will engage the skin one behind the other, and members of plastics material which provide a guard surface for engaging the skin ahead of the leading cutting edge, a cap surface for engaging the skin behind the rear cutting edge, and means for detachably coupling the shaving unit to a cooperating razor handle. However, it will be apparent that the invention can be applied to containers for other types of replaceable elements of safety razors. In the drawings:

Figure 1:
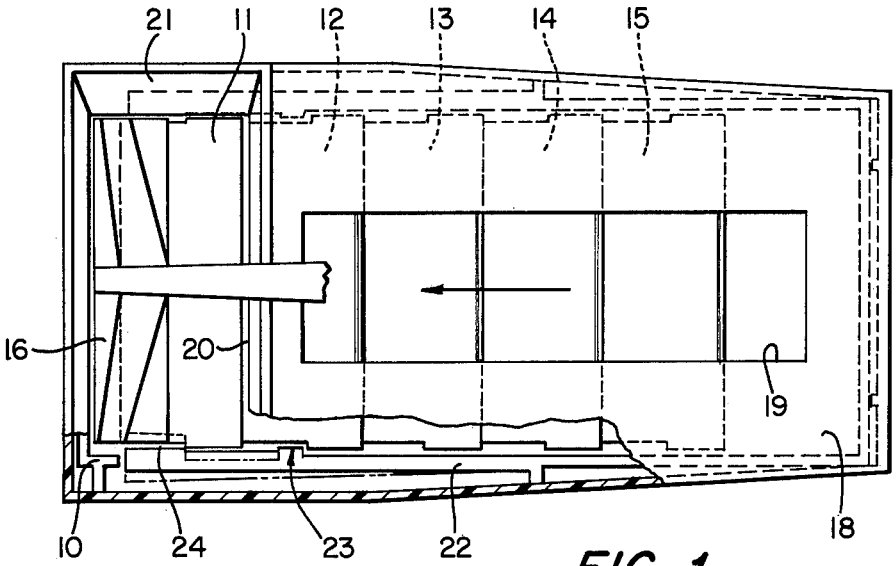
FIG. 1 is a plan view, partly in section, of one form of container in accordance with the invention, with a cooperating handle located in the loading position.
Figure 2:
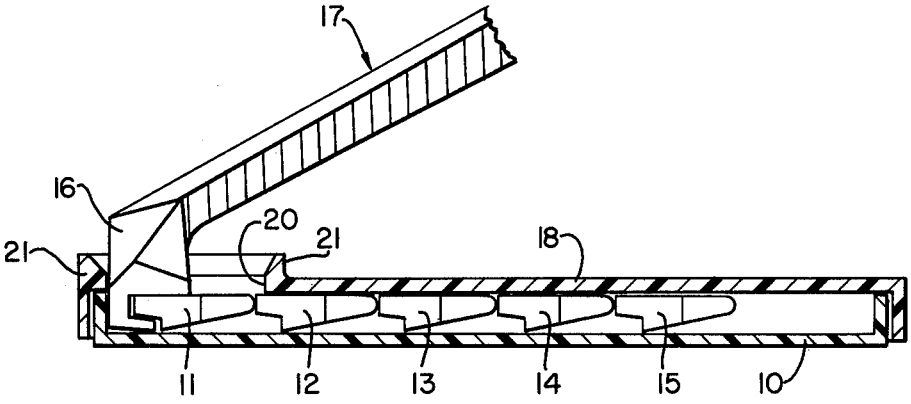
FIG. 2 is a sectional side view of the assembly shown in FIG. 1.

Referring first to FIGS. 1 and 2, the container comprises an opentopped tray 10 which accommodates five shaving units or cartridges, 11–15, disposed parallel to one another in side by side relationship with their lengths transverse to the length of the tray. The faces of the cartridges on which the blades are exposed are directed downwardly, so that the cutting edges are protected by the tray. The cartridges each have one longitudinal edge portion (on the left in the drawing) shaped for engagement between a pair of jaws provided on the head 16 of a razor handle 17, the jaws being operated by spring means or by clamping mechanism (not shown). A flanged cover 18 fits over the tray and is firmly secured to it to enclose and retain the cartridges. The cover is formed with an elongated aperture 19 which allows the user access to the upper surfaces of the cartridges, so that the user can push them towards one end of the container (namely the left hand end) to bring the leading cartridge into a loading position. Above that position, the cover is formed with a second aperture 20 surrounded by a raised, internally bevelled wall 21, permitting the insertion into the loading position of the container the head 16 of the razor handle and its subsequent removal carrying one of the cartridges. Parallel to and within one side wall of the tray there is a longitudinally extending resiliently flexible latch arm 22, one end of which is anchored to the tray wall. Intermediate its ends, the arm 22 is formed with a projection 23 which (when the arm is in its normal position, as shown in full lines) engages a shoulder on the cartridge in position 12 and prevents movement to the left of that cartridge and of any lying to the right of it. At its free end the arm 22 is formed with a cam surface 24 which is engaged by the head of the razor handle when in the loading position, thus deflecting the latch arm 22 to the position shown in broken lines and moving the projection 23 clear of the cartridges.

The cartridges are intially stored in the container with the leading cartridge 11 in the position shown occupied by the cartridge 12, so that leftward movement of all the cartridges is prevented by the latch arm 22. The head of the razor handle is inserted through the aperture 20 and exactly located by engagement with the appropriately shaped and dimensioned internal surfaces of the container, the spring pressure exerted upon the head by the deflected spring latch arm serving to hold the handle in the correct position. The deflection of the arm 22 allows the cartridges to be moved to the left to bring the leading cartridge 11 into engagement with the razor handle, this being the position shown in the drawings. The handle, thus loaded with a cartridge, can then be lifted out of the container and is ready for use. The removal of the handle allows the latch arm 22 to return to its normal position, preventing any further leftward feed of the cartridges until the handle (not loaded with a cartridge) is again inserted into the loading position.

Figure 3:
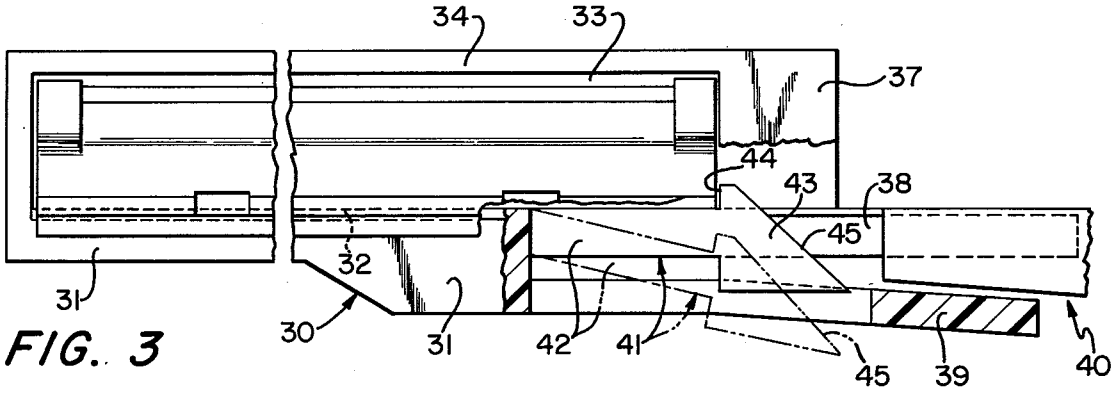
FIG. 3 is a front view (with parts broken away and in section) of a second form of container in accordance with the invention and of part of a cooperating handle.
Figure 6:
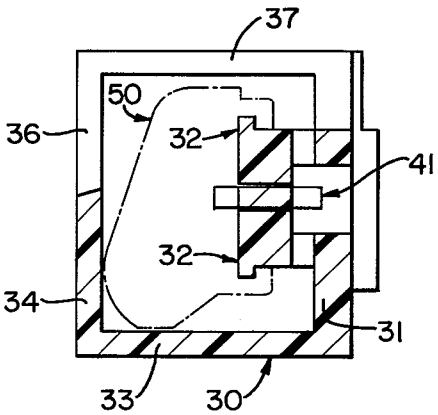
FIG. 6 is a section taken on the line VI—VI of FIG. 4.
Figure 5:
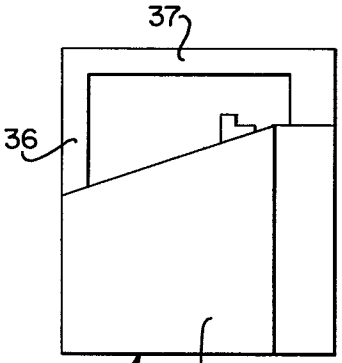
FIG. 5 is an end view thereof.
Figure 4:
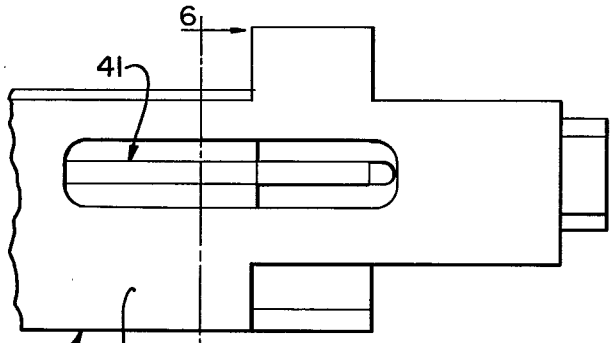
FIG. 4 is an underside view of one end of the container of FIG. 3.

The container shown in FIGS. 3–6 is adapted to hold a single cartridge of the construction described and illustrated in U.S. Pat. Nos. 3,703,764; 3,724,070; and 3,832,774. It is constituted by a single integral molding 30 of a suitable plastics material shaped to provide a base 31 whose upper surface is formed with opposed outwardly directed flanges constituting guide rails 32 with which the cartridge 50 is engaged for longitudinal sliding movement, a rear wall 33, a top 34 which projects sufficiently over the cartridge to protect the exposed blade edges but leaves the front portion of the cartridge exposed, and one end wall 35 which prevents movement of the cartridge to the left. The base 31, rear wall 33 and top 34 extend beyond the right hand end of the cartridge and this part of the top is extended forwardly (as indicated at 36) and joined to the base by a front member 37, forming a dispensing opening through which the cartridge must pass when moved to the right. The rightward extension of the base is bifurcated, providing an elongated upper portion 38 aligned with the longitudinal axis of the guide rails and a downwardly sloping lower portion 39. The cross-section of the portion 38 is such that it will fit slidingly within the channel section 40 of a razor handle adapted to cooperate with the stored cartridge. When one end of the head is thus engaged with the portion 38, as indicated in FIG. 3, the base of the channel fits into the slot between the portions 38 and 39 and the outwardly projecting flanges at the mouth of the channel are aligned with the guide rails 32 of the container on which the cartridge is stored.

Slots formed through the base 31 between the guide rails define a latch member 41 which comprises a spring arm 42 whose left hand end is integral with the remainder of the base, while its right hand end is integral with an approximately triangular plate-like portion 43, the top of which normally projects above the guide rails and forms a hook 44, while its right hand edge sloping downwardly and to the right, forms a cam surface 45 for engagement by the razor handle. When the latch member is in its normal position (as shown in full lines in the drawings) the hook prevents movement of the cartridge 50 to the right, movement in any other direction being prevented by the guide rails and end wall. When an appropriate razor handle is engaged with the container, as indicated in FIG. 3, and moved further to the left, the base of its channel section, passing between the portions 38 and 39, engages the cam surface 45 of the latching member and deflects the latter into the position shown in dotted lines in FIG. 3, thus withdrawing the hook 44 from the path of the cartridge 50 and allowing the latter to be slid into engagement with the razor handle, which can then be withdrawn with the cartridge correctly positioned on it. Should an attempt be made to withdraw the razor handle while the cartridge has been only partly transferred onto the handle, the latch member 41 will return resiliently to its normal position and the hook 44 will engage one of a number of transverse ribs (not shown) which are present on the underside of the cartridge, thus preventing further withdrawal. The frame or shroud constituted by the parts 36, 37 serves to prevent accidental depression of the hook and unintended release of the cartridge.

Having thus described my invention what I claim as new and desire to secure by Letters Patent of the United States is:

1. A container for storing and dispensing a replaceable shaving unit, comprising means for locating a razor handle in a loading position in which said shaving unit can be transferred from a storage position in a storage compartment in the container to a position of operative engagement with the handle, and latch means blocking endwise movement of said shaving unit from its storage position, said latch means being operated to release said shaving unit by abutment with said razor handle in said loading position, said storage compartment comprising a base wall with upstanding guide rail means for receiving said shaving unit, said guide rail means comprising a pair of opposed parallel flanges directed outwardly away from each other, wherein said latch means compreses a contilever spring member extending parallel with said guide rail means and having a hook portion normally partially obstructing said dispensing opening, an end wall to prevent sliding movement of said unit towards that end, and a dispensing opening at the opposite end of said compartment.

2. A container according to claim 1, wherein said location means is adapted to guide said razor handle in a direction parallel with said guide rail means into said loading position.

3. A container according to claim 2 wherein said location means comprises an elongate member aligned with the longitudinal axis of said guide rail means.

* * * * *